US006789675B2

(12) United States Patent
Abe et al.

(10) Patent No.: US 6,789,675 B2
(45) Date of Patent: Sep. 14, 2004

(54) LIGHT-SENSITIVE MATERIAL PACKAGE

(75) Inventors: Hirofumi Abe, Kanagawa (JP); Yoshio Hara, Kanagawa (JP); Reiko Furuya, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 212 days.

(21) Appl. No.: 10/212,053

(22) Filed: Aug. 6, 2002

(65) Prior Publication Data

US 2003/0029766 A1 Feb. 13, 2003

(30) Foreign Application Priority Data

Aug. 6, 2001 (JP) ..... 2001-237641

(51) Int. Cl.[7] ..... B65D 85/48

(52) U.S. Cl. ..... 206/455; 206/521; 206/523; 206/449

(58) Field of Search ..... 206/449, 521, 206/523, 455, 499, 520, 555, 497; 428/913; 43/497

(56) References Cited

U.S. PATENT DOCUMENTS 4,992,815 A * 2/1991 Kudo ..... 396/518
5,246,121 A * 9/1993 Mitake et al. ..... 211/41.13
5,270,901 A * 12/1993 Nowak et al. ..... 361/212
5,323,905 A 6/1994 Gerondale et al.
5,370,229 A 12/1994 Kroeckel et al.
5,447,234 A 9/1995 Faulstick et al.
5,649,411 A * 7/1997 Dirx ..... 53/492
5,884,451 A * 3/1999 Kano et al. ..... 53/411
5,893,002 A * 4/1999 Dirx ..... 396/518
5,907,946 A * 6/1999 Oishi et al. ..... 53/471
6,026,955 A * 2/2000 Dirx ..... 206/455
6,289,650 B1 * 9/2001 Usui et al. ..... 53/381.1

FOREIGN PATENT DOCUMENTS

| | | |
|---|---|---|
| JP | 5-119439 | 5/1993 |
| JP | 5-249616 | 9/1993 |
| JP | 6-43802 | 6/1994 |
| JP | 2001-2141 | 9/2001 |

* cited by examiner

*Primary Examiner*—Jila M. Mohandesi
(74) *Attorney, Agent, or Firm*—Sughrue Mion, PLLC

(57) ABSTRACT

A light-sensitive material package includes a light-shielding envelope containing a stack of sheet-form light-sensitive material, the light-shielding envelope having heat-seal parts on four edges. The light-sensitive material package further includes a cushioning member, which holds down all or a part of the heat-seal parts. The light-sensitive material package further includes a fitting-type box for storing the envelope, the fitting-type box being formed from an inner box and a lid. The stiffness of the heat-seal parts is at least 0.05 N·cm.

19 Claims, 7 Drawing Sheets

LIGHT-SENSITIVE MATERIAL PACKAGE

BACKGROUND OF THE INVENTION

1. Field of the Invention

The present invention relates to a sheet-form light-sensitive material package and, more particularly, a light-sensitive material package that can eliminate bag tear and damage to the light-sensitive material that may be caused during transport, etc.

2. Description of the Related Art

Conventionally, packaging of sheet-form light-sensitive material is generally carried out by sandwiching or wrapping the sheet-form light-sensitive material in a paper or plastic sheet, which is called a protecting sheet, and then placing it in a light-shielding moisture-resistant bag, and then in a fitting-type box (also known as a 'telescoping' or 'double tray' box). In this case, since the sheet-form light-sensitive material is stacked in layers, the bag forms sharp corners, thereby causing a lot of trouble with bag tear during transport or when dropped. As countermeasures therefor, JP-A-7-149370 (JP-A denotes a Japanese unexamined patent application publication) discloses a corner treatment, and JP-A-6-199378 discloses placing a flexible material such as a corner packing or a foam in four corners as shown in FIG. 4 therein. Furthermore, JU-B-6-43802 (JU-B denotes a Japanese examined utility model application publication) discloses a method for preventing bag tear by placing cushioning blocks in four corners.

Light-sensitive materials that are used in industrial applications are required to have little change in film size and therefore have a thick support and, moreover, due to a large film size the weight of the stored product is considerable.

The above-mentioned methods therefore cannot prevent a product-storing bag itself from moving within a box, and bag tear occurring on dropping cannot be eliminated completely. Furthermore, light-sensitive materials for industrial applications might have a matte film surface so that vacuum degassing can be easily carried out when exposing to light. There is therefore the problem that movement of the product within the box or the bag during transport causes scratches or pressure fogging, and when fine lines are exposed the lines are incomplete.

BRIEF SUMMARY OF THE INVENTION

It is an object of the present invention to provide a light-sensitive material package that can prevent bag tear caused when a sheet-form light-sensitive material package is transported, and that can eliminate damage such as scratches and pressure fogging of the light-sensitive material caused during transport.

The above-mentioned objects of the present invention have been attained by the following means.

A light-sensitive material package comprising a light-shielding envelope containing a stack of sheet-form light-sensitive material, the light-shielding envelope having heat-seal parts on four edges, a cushioning member for holding down all or a part of the heat-seal parts, and a fitting-type box comprising an inner box and a lid, the fitting-type box storing the envelope, and the stiffness of the heat-seal parts being at least 0.05 N·cm.

DETAILED DESCRIPTION OF THE INVENTION

One mode for carrying out the present invention is explained below by reference to the drawings.

Figure 1:
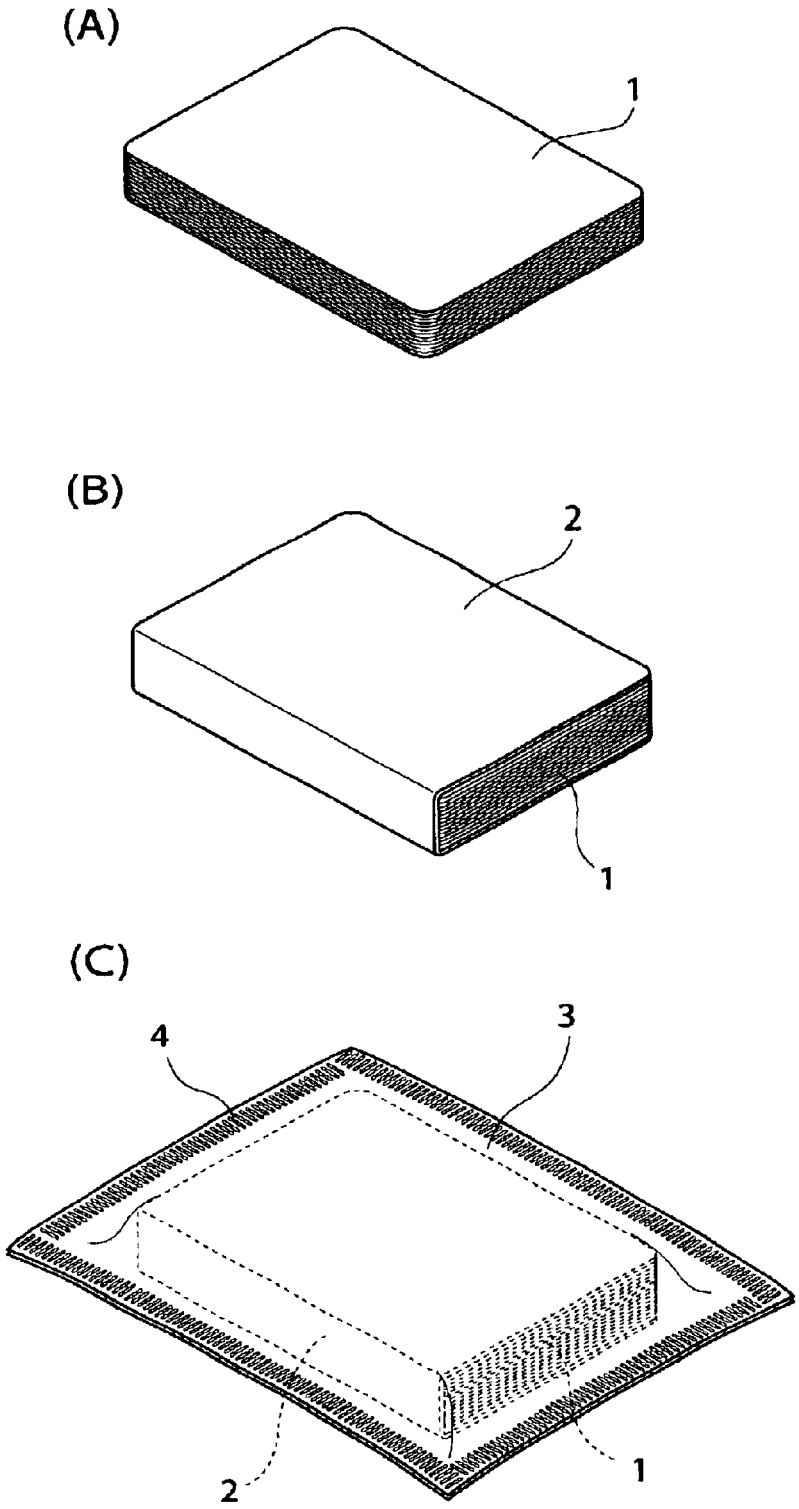
FIGS. 1A to 1C are perspective views showing one embodiment of the present invention in which a sheet-form light-sensitive material stack is stored in an envelope.
Figure 2:
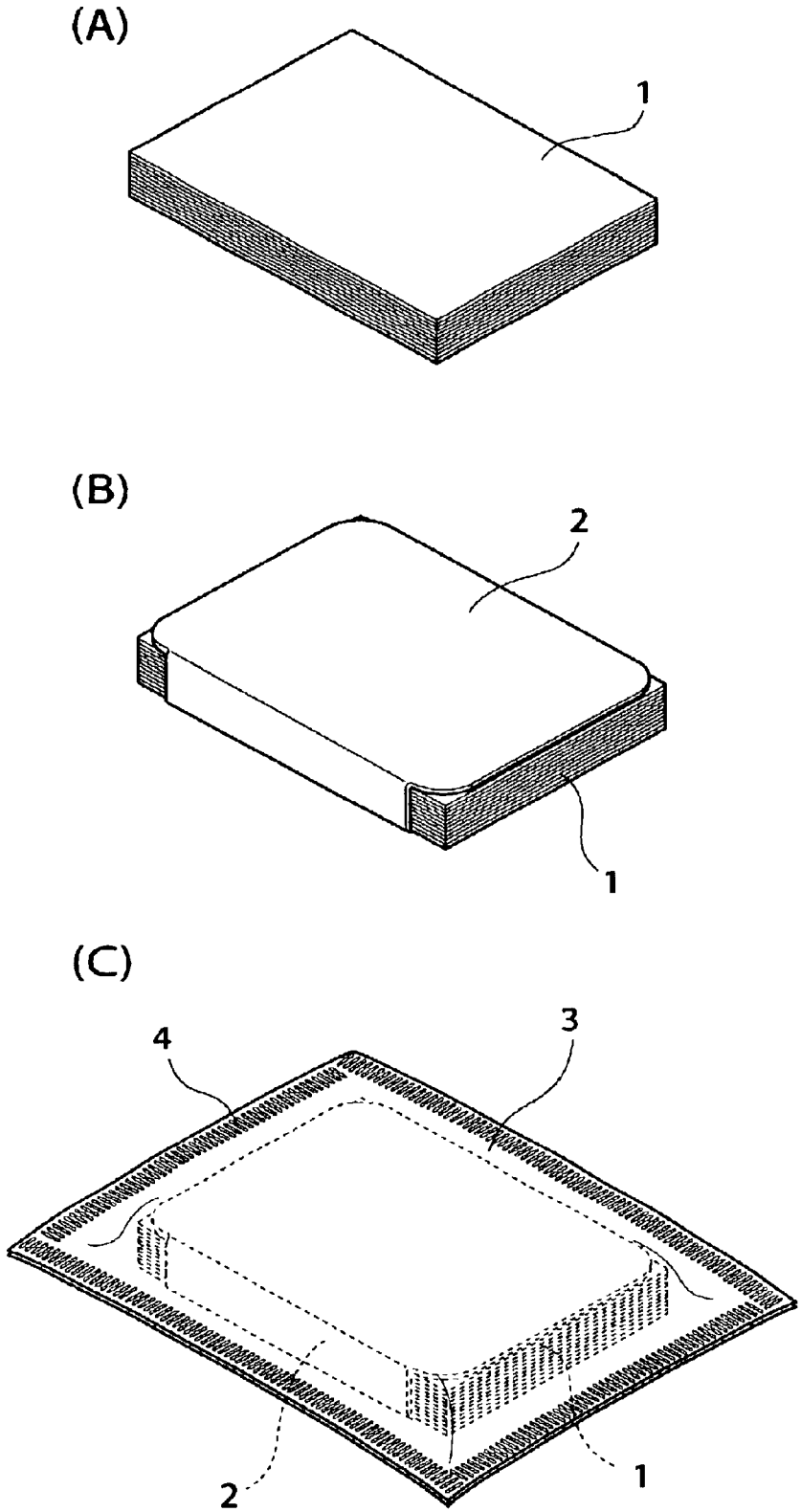
FIGS. 2A to 2C are perspective views showing one embodiment of the present invention in which a sheet-form light-sensitive material stack is stored in an envelope.

Referring to FIGS. 1 and 2, a sheet-form light-sensitive material stack 1, which may have rounded corners, is protected with a protecting sheet 2, which is a polypropylene sheet having a U-shaped (or horseshore) cross section, and stored in an envelope 3, the four edges of the envelope 3 forming broad heat-seal parts 4.

Figure 3:
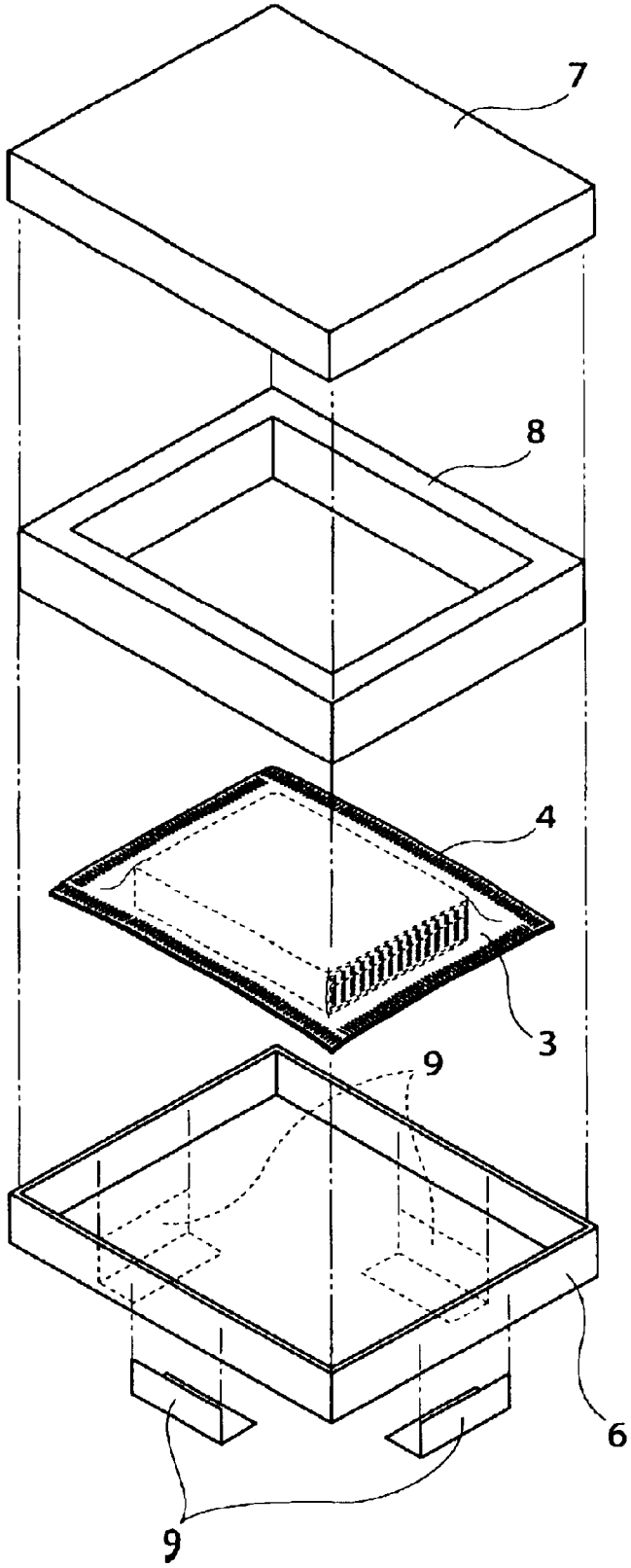
FIG. 3 is an exploded perspective view schematically showing one embodiment of the light-sensitive material package of the present invention.
Figure 4:
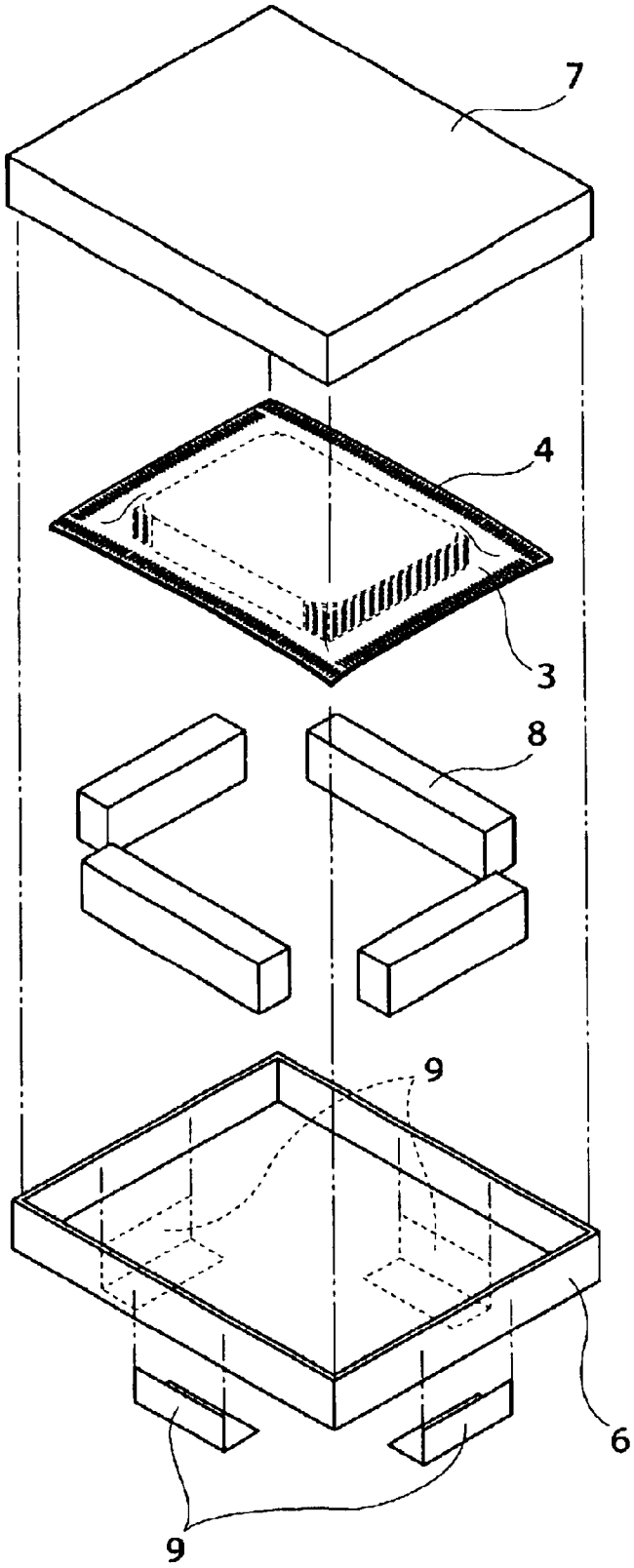
FIG. 4 is an exploded perspective view schematically showing one embodiment of the light-sensitive material package of the present invention.

Turning to FIGS. 3 and 4, this envelope 3 is stored within a rectangular parallelepiped container (fitting-type box) comprising a body 6 and a lid 7, and the body 6 and the lid 7 of the fitting-type box are secured by means of a pressure-sensitive tape 9. A cushioning member 8 sandwiched between the body 6 and the lid 7 of the fitting-type box is arranged so as to press at least a part of the heat-seal parts against the inner base of the body 6 or the inner top face of the lid 7, thereby restraining movement of the envelope.

Figure 5:
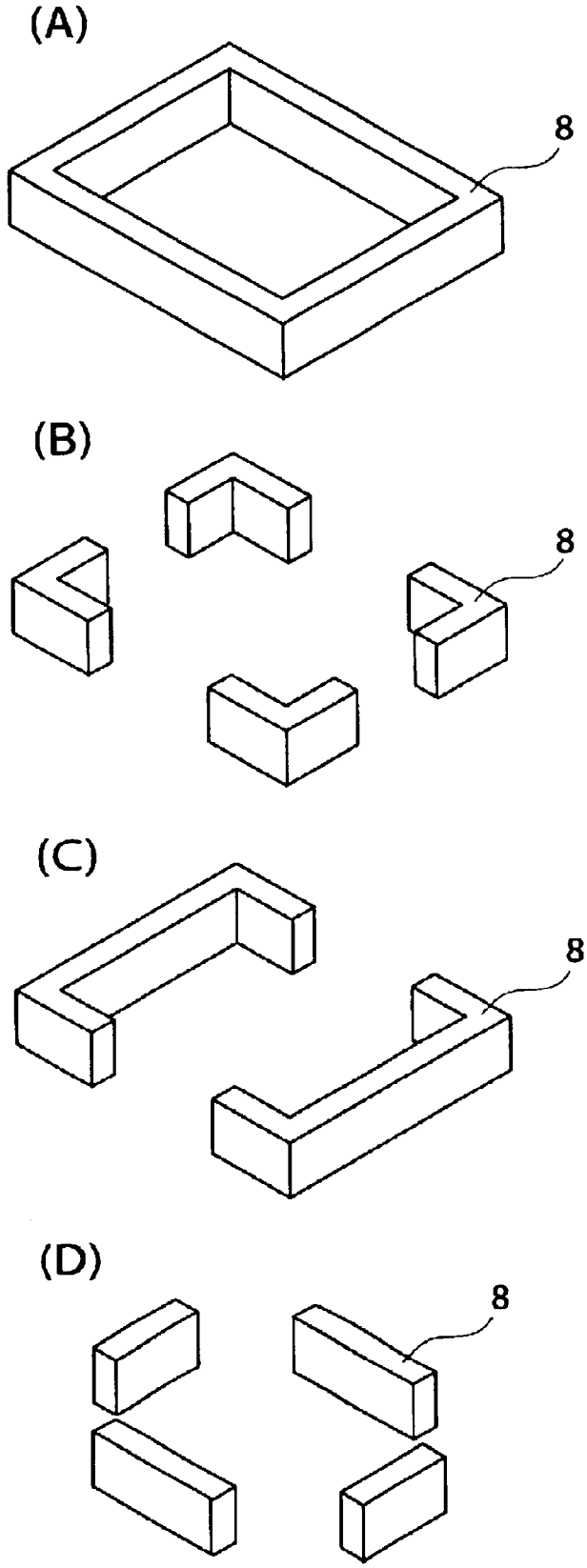
FIGS. 5A to 5D are perspective views schematically showing several configurations of a cushioning member used in the light-sensitive material package of the present invention.
Figure 6:
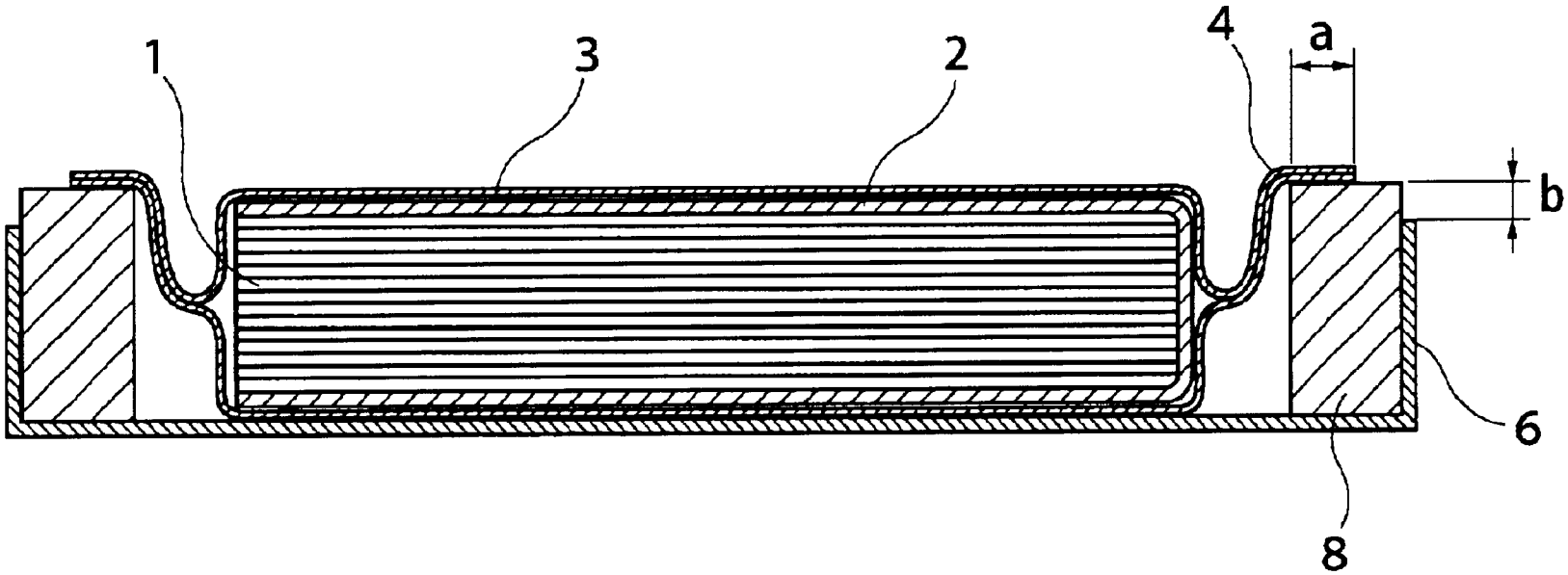
FIG. 6 is a cross section of the light-sensitive material package of the present invention schematically showing the amount of cushioning member that is held down and the amount that is pushed down by the box.

The cushioning member has a variety of shapes as shown in FIG. 5, and is preferably in a shape that substantially evenly fixes the four heat-seal part edges at the periphery of the envelope. The extent to which they are fixed depends on a width a over which the heat-seal parts are held down and a height b that the cushioning member is compressed by, as shown in FIG. 6.

The light-sensitive material package of the present invention relates to a stack of sheet-form light-sensitive material. The stack of sheet-form light-sensitive material is enclosed in a light-shielding envelope, and this envelope is stored in an external box that has a configuration wherein one half thereof fits into the other half. The stack of light-sensitive material may be enclosed directly in the light-shielding envelope, or the stack may be packaged with a protecting sheet and then stored in the envelope. The protecting sheet is a packaging member for the stack of light-sensitive material and makes direct contact with the light-sensitive material, and it is therefore desirable for it not to adversely influence the light-sensitive material. With regard to a material for the protecting sheet, the content of substances harmful to the light-sensitive material is usually at most 1,000 PPM; it is necessary for such substances to have substantially no influence on the light-sensitive material, and in order to prevent the occurrence of spots when taking photographs it is preferable to use a material that forms little dust.

With regard to the protecting sheet, more specifically, the influence of harmful substances is preferably eliminated, for example, by using a material in which the content of the aforementioned photographically harmful substances is at most 1,000 PPM, or by providing the surface of the protecting sheet with a protective film of a UV curable resin. As the protecting sheet, it is preferable to use various types of plastic sheet, or paper made from pulp having a fiber length of 3 mm or above. Specific examples of the paper include paper with added paper strengthening agent, resin laminated paper, latex- or resin-impregnated paper, paper surface coated with resin, starch, or PVA, surface-sized paper, synthetic paper, dust-free paper, and neutral paper. Specific examples of the plastic sheet include polyethylene sheet and polypropylene sheet. With regard to the protecting sheet used in the present invention, a plastic sheet is preferably used, and a polypropylene sheet is particularly preferred.

The thickness of the protecting sheet is preferably 300 to 700 $\mu$m, and the stiffness is preferably 0.05 to 0.1 N·cm. The stiffness referred to here denotes a bending moment of the protecting sheet, and details of the measurement method are specified in JIS P8125. The surface roughness of the protecting sheet is preferably 10 to 500 $\mu$m. The surface roughness referred to here denotes the average gap between projections and depressions of the protecting sheet, and details of the measurement method are specified in JIS B0601. Furthermore, the wetting tension of the protecting sheet is preferably $4\times10^{-3}$ to $5\times10^{-3}$ N/m (40 to 50 dyne/cm). Details of the method for measuring the wetting tension are specified in JIS K6768.

The sheet-form light-sensitive material of the present invention is preferably made so that the four corners of the rectangle are rounded, thereby further suppressing bag tear.

The protecting sheet preferably has a shape that covers the whole lower face of the stack of sheet-form light-sensitive material, and preferably has a shape having a U-shaped cross section that also covers the whole upper face of the stack.

The stack of sheet-form light-sensitive material is stored in the light-shielding envelope directly or with the protecting sheet packaging. The envelope used in the present invention is preferably a completely light-shielding inner packaging material having moisture resistance. The envelope can employ various known bag formats including a single layer flat bag, a double layer flat bag, a single layer gusset bag, and a double layer gusset bag.

More specifically, the single layer bag employs an inner packaging material formed by extruding molten PE (in an amount corresponding to a thickness of 13 $\mu$m) and laminating 80 $\mu$m thick BPE (Black Polyethylene) on 40 $\mu$m thick BOPP (Biaxially Oriented Polypropylene) using the above PE as an adhesive. In the case of the double layer bag, the above-mentioned inner packaging material is used as an outer bag, and an inner packaging material formed by extrusion laminating molten PE (in an amount corresponding to a thickness of 13 $\mu$m) on the BOPP surface of the above-mentioned inner packaging material is used as an inner bag.

The stiffness of the inner packaging material is preferably at least 0.01 N·cm, and the tear strength of the inner packaging material is preferably at least 1.5 N·cm. The method for measuring this tear strength is as specified in JIS P8116.

The process for making a bag can be carried out by appropriately choosing a conventionally known process for sealing a plastic film such as heat sealing, fusion sealing, impulse sealing, ultrasonic sealing, and radio frequency sealing according to the properties of the inner packaging material used here. It is also possible to make a bag using an appropriate adhesive, pressure-sensitive adhesive, etc. In the present invention, the four edges of the light-shielding envelope are heat-sealed. If there is insufficient stiffness in the heat-seal parts 4 in FIG. 4, even when the envelope is held down by the cushioning material the bag moves within the fitting-type box, thereby making it impossible to prevent any damage to the light-sensitive materials. Moreover, when the stiffness is too high, the process suitability becomes poor. It is therefore necessary for the stiffness of the heat-seal parts 4 to be at least 0.05 N·cm, and the stiffness is preferably at most 1 N·cm.

The box storing the envelope is for protecting and storing the light-shielding envelope in which the sheet-form light-sensitive material stack is contained. A specific example of the box is formed from a rectangular parallelepiped that is thin overall, and has an inner box (body) and a lid that can be fitted together.

The material of the fitting-type box is not particularly limited, and it may be a paper box or a plastic box as long as it has a strength that is sufficient for use according to the size and the weight of the stack of sheet-form light-sensitive material. In the case where a paper box is used as the fitting-type box it is preferable to laminate a paper made from long fiber pulp and having high surface strength on the inside of the fitting-type box or to laminate a low dust forming flexible sheet such as a plastic film or a dust-free paper on the inside as described later. Further adding carbon black or a conductive substance to the fitting-type box is preferable in terms of prevention of dust adsorption and static.

With regard to the light-sensitive material package of the present invention, it is preferable to reduce the pressure within the envelope immediately before or after subjecting the envelope to heat sealing. Reducing the pressure to about 10 to 500 mm·$H_2O$ can restrain movement of the light-sensitive material stack within the envelope.

With regard to the package of the present invention, the envelope is stored within the fitting-type box. The use of a flexible cushioning member in this situation so as to restrain movement of the envelope within the fitting-type box is a feature of the present invention. Preventing movement of the envelope within the fitting-type box can prevent malfunctions such as bag tear, scratching of the light-sensitive material sheets, and abrasion marks, and generation of dust.

The cushioning member can be placed either above (enclosed above) or beneath (enclosed below) the heat-seal parts (hereinafter also called 'edges') of the envelope stored in the inner box (body), and closing the fitting-type box holds down the edges of the envelope, thereby preventing movement of the envelope within the fitting-type box during transport. When the cushioning member is disposed above the edges of the envelope, the edges of the inner packaging member are held down by the cushioning member and the inner box (body). When the cushioning member is disposed beneath the edges of the envelope, the edges of the inner packaging member are held down by the cushioning member and the lid.

The cushioning member may be either enclosed above or enclosed below, but taking manufacturability into account it is preferable for it to be enclosed below. The cushioning member can have any configuration as long as longitudinal and lateral movement of the envelope within the fitting-type box can be restrained. Although it is most effective for the cushioning member to be disposed along the whole length of the four edges of the envelope, an effect can be obtained even with it on the corners of the envelope alone, or on a part of the four edges of the envelope. That is, the object of the present invention can be accomplished as long as the envelope is stored within the fitting-type box in a state in which all or a part of the heat-seal parts of the envelope is held down, thereby preventing any undesirable movement of the envelope within the fitting-type box.

The width (amount held down a) over which the cushioning member holds down the heat-seal parts is preferably 2 to 10 mm, and particularly preferably 4 to 6 mm.

When the cushioning member is enclosed below, in the case where the depth of the fitting-type box is 20 mm the height (amount that box pushes down b) that the heat-seal parts are to be pushed down between the cushioning member and the lid of the fitting-type box is preferably 1 to 5 mm before the lid is applied, and particularly preferably 2 to 4 mm.

In order for the cushioning member to exhibit its function, it is necessary for the cushioning member to be compressed within the fitting-type box between the bottom sheet and the top sheet of the fitting-type box while sandwiching the heat-seal parts. When using the body and lid that can fit together, the two are therefore preferably fixed by appropriate means and there is, for example, a method in which the body and lid of each of the fitting-type boxes are fixed by a pressure-sensitive tape. It is also possible to stack several fitting-type boxes on top of each other and fix the outside of the stack on all sides using a strong tape.

As for the cushioning member, a conventionally known flexible material can be chosen appropriately, but a material that forms little dust is preferred. Examples thereof include foams comprising a foaming agent and a polyolefin resin such as various types of polyethylene resin, various types of polypropylene resin, and polybutene resins; ethylene copolymer resins such as polystyrene resins; copolymer resins having propylene as a main component; mixed resins of a polyolefin cross-linked resin or a polyamide resin and one or two or more of the above-mentioned resins; polyurethane; natural rubber (sponge made from rubber latex stock); and synthetic rubber such as SBR.

A preferable cushioning member that can be used effectively in the present invention is a foamed thermoplastic resin having as a main component substantially a polyolefin resin (including modified resins, cross-linked resins, etc.) including various types of high density, medium density, and low density polyethylene resins, linear low density polyethylene (L-LDPE) resins, polypropylene resins, propylene-ethylene copolymer resins, ethylene-vinyl acetate copolymer resins, ethylene-acrylate ester copolymer resins, ethylene-acrylic acid copolymer resins, and polystyrene copolymer resins. In particular, foamed polyethylene is preferred in terms of cost and properties. The foam expansion factor is 10 to 70 times, and preferably 20 to 40 times.

With regard to the foaming agent, either an inorganic foaming agent or an organic foaming agent may be used. Examples of the inorganic foaming agent include sodium hydrogen carbonate, ammonium carbonate, and ammonium hydrogen carbonate. Examples of the organic foaming agent include azobisisobutyronitrile, azodicarbonamide, and barium azodicarboxylate. With regard to processes for forming a foam by adding a foaming agent to a plastic material or a rubber material, there are a gas-mixing method, a foaming-agent decomposition method, a solvent-evaporation method, a chemical reaction method, a sintering method, a leaching method, etc., and any method can be used.

In order to prevent dirt and dust from adhering to the foam due to static an antistatic agent may be added. With regard to the antistatic agent, there can be cited as an anionic type an alkylphosphate ester, as a cationic type an alkylamino derivative and a quaternary ammonium salt, as an amphoteric type an imidazoline type metal salt, and as a nonionic type a polyoxyethylene alkylamine, a polyoxyethylene fatty acid ester, and a polyoxyethylene alkyl ether. More specifically, dioxyethylene stearic acid amine, an alkylamine lubricant (e.g., that with the product name Electrostripper), stearic acid monoglyceride, etc. can preferably be used.

In the present invention, it is also possible to use an air cushion, etc. instead of a foam as the cushioning member.

Furthermore, in the present invention, by making a fitting-type box that generates no paper dust during transport using a material formed by laminating a thermoplastic resin layer on the front and back surfaces of a paperboard (hereinafter, termed 'packaging material for light-sensitive material' in the present invention) and using it for packaging the envelope it becomes possible to reduce the attachment of dirt to the outside of the envelope during transport and provide a product having a high level of cleanliness. Furthermore, laminating a thermoplastic resin layer on the outside of the fitting-type box makes the surface have a state closer to that of a plastic, thus making the surface easy to clean and thereby making it easy to reuse.

A preferable embodiment of the present invention is explained below by reference to a drawing.

Figure 7:
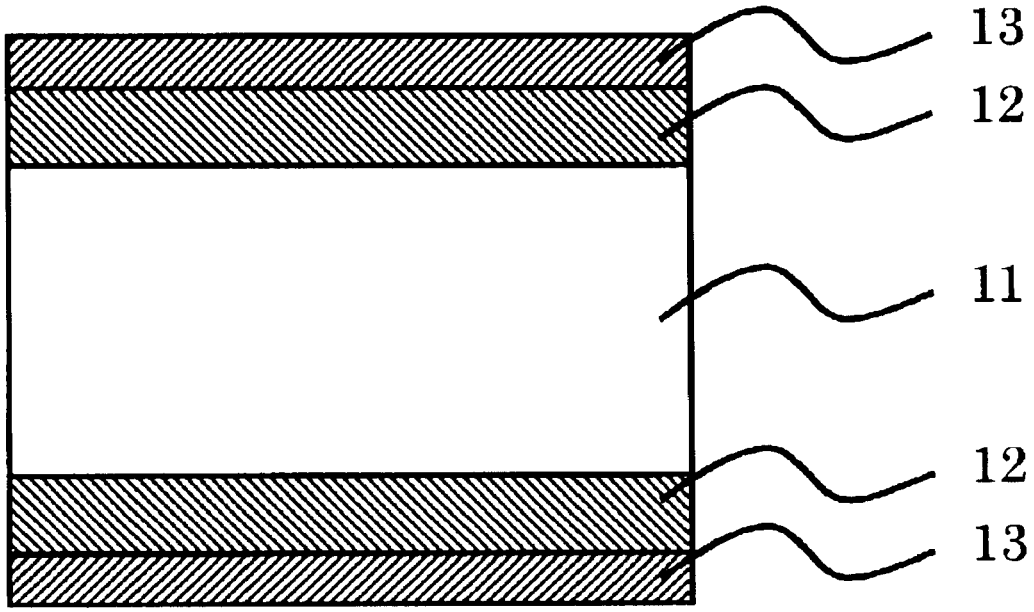
FIG. 7 is a cross section schematically showing one embodiment of the packaging material for light-sensitive material used in the present invention.

As shown in FIG. 7, the packaging material for light-sensitive material has thermoplastic resin layers 13 laminated on ordinary paper 12 on either side of a paperboard 11.

The packaging material for light-sensitive material is used for a fitting-type box used for packaging an envelope storing a stack of sheet-form light-sensitive material, and is a packaging material obtained by laminating the front and back sides of the paperboard with the thermoplastic resin layer.

Since the paperboard is a packaging member for a stack of light-sensitive material, it is desirable for it not to adversely influence the light-sensitive material. The content of substances harmful to the light-sensitive material in the paperboard material is usually at most 1,000 PPM, it is necessary for there to be substantially no influence on the light-sensitive material, and in order to prevent the occurrence of spots when taking photographs it is preferable to use a material that forms little dust.

With regard to the paperboard, any paperboard may be used as long as it has a strength sufficient for use in relation to the size and weight of the stack of sheet-form light-sensitive material, and it is preferable to use various types of paper made from pulp having a weight-average fiber length of 3 mm or above. Specific examples of the paper include paper with added paper strengthening agent, latex- or resin-impregnated paper, surface-sized paper, synthetic paper, dust-free paper, and neutral paper.

The basis weight of the paperboard (chipboard basis weight) is preferably 450 to 1,950 g/m$^2$, and more preferably 1,000 to 1,950 g/m$^2$.

The thickness of the paperboard is preferably 2 to 3 mm. In the present invention, a fitting-type box may be formed from a single sheet of paperboard or by bonding a plurality of paperboards together. When bonding a plurality of paperboards together, the thickness of the bonded paperboards is preferably in the above-mentioned range.

The stiffness of the paperboard is preferably 1.96 to 19.6 N·cm (200 to 2,000 gf·cm) when a single sheet of non-bonded paperboard is measured. When bonding a plurality of paperboards together, the stiffness of the bonded paperboards exceeds the above-mentioned value. The stiffness referred to here denotes a bending moment of the paperboard, and details of the measurement method are specified in JIS P8125.

The surface roughness of the paperboard is preferably 10 to 100 μm. The surface roughness referred to here denotes the average gap between projections and depressions of the paperboard, and details of the measurement method are specified in JIS B0601.

In the present invention, the resin used in the thermoplastic resin layer may be any resin as long as it gives an effect of suppressing the generation of paper dust when it is laminated on the paperboard so that the paperboard does not produce paper dust in the same manner as is the case with conventional paper when its surface is rubbed.

More specifically, polyolefins such as polyethylene (PE) and polypropylene (OPP, CPP), polyesters such as polyethylene terephthalate (PET) and polybutylene terephthalate, polyamides such as nylon 66, nylon 66, nylon 11 and nylon 12, polystyrene, polystyrene copolymers, etc. can preferably be used.

Adding carbon black or a conductive material to the thermoplastic resin layer is preferable in terms of preventing dirt and dust from becoming attached due to static.

The thickness of the thermoplastic resin layer is preferably 10 to 200 μm, more preferably 10 to 100 μm, and most preferably 10 to 70 μm.

With regard to a method for laminating a thermoplastic resin layer on a paperboard, a conventionally known method can be used, and in the present invention a method in which a thermoplastic film is laminated on a paperboard is preferred. With regard to specific lamination methods, a dry lamination method, a non-solvent lamination method, an extrusion lamination method, etc. can be cited.

As one embodiment of the present invention, a thermoplastic resin layer such as a biaxially stretched PET film can be laminated on a paperboard by the dry lamination method. In this case, a comparatively thin film having a thickness of 10 to 20 μm is preferably used. More specifically, Lumirror #12 (manufactured by Toray Industries, Inc., PET, thickness 12 μm) can be laminated on a paperboard by the dry lamination method. As a specific example of a dry lamination adhesive used in the dry lamination method, a mixture of E263 (main agent) and C-26 (setting agent) at 3:1 manufactured by Dainichiseika Color & Chemicals Mfg. Co., Ltd. can be cited.

In another embodiment of the present invention, instead of laminating the thermoplastic resin layer directly on the paperboard, a thermoplastic resin layer such as a polyolefin can first be laminated on a paper other than the paperboard, preferably a paper having a basis weight less than that of the paperboard, and this can then be laminated on the paperboard. In this case, it is preferable to use a comparatively thick film having a thickness of 30 to 100 μm. For example, a thermoplastic resin can be laminated by the extrusion lamination method on an ordinary paper having a basis weight of about 180 to 320 g/m$^2$, and this can then be bonded to a paperboard using an adhesive such as an emulsion type adhesive. With regard to the adhesive, any adhesive can be used as long as it does not adversely influence the light-sensitive material.

The thermoplastic resin layer is preferably laminated on both the front and back sides of the paperboard, but it is also possible to laminate it on one side of the paperboard alone.

When forming a fitting-type box using the packaging material for light-sensitive material formed by laminating the thermoplastic resin layers on the front and back sides of the paperboard, both the inside and the outside of the fitting-type box are covered with the thermoplastic resin. It is therefore possible for a dust generation prevention effect to be imparted to the inside of the fitting-type box and at the same time for the outside of the fitting-type box to be resistant to soiling, and even when dirt adheres thereto it can easily be cleaned off, thereby making the fitting-type box reusable. Furthermore, since both sides of the paperboard are provided with a thermoplastic resin layer, the moisture resistance of the two sides of the paperboard is well balanced, thereby suppressing curling of the paperboard.

When forming a box-shaped fitting-type box using the packaging material for light-sensitive material formed by laminating a thermoplastic resin layer on one side of the paperboard alone, it is preferable to use the side with the laminated thermoplastic resin layer as the inside of the fitting-type box.

The fitting-type box formed from the packaging material for light-sensitive material is for protecting and storing the light-shielding envelope containing the stack of sheet-form light-sensitive material, and as described above a box comprising a rectangular parallelepiped that is thin overall and having an inner box (body) and a lid that can be fitted together can be cited as a specific example.

In the fitting-type box used in the present invention, the whole surface of the paperboard forming the body 6 and the lid 7, that is, the entire paperboard including the front and back sides and the cross sections, is covered with a plastic, and paper dust is preferably not generated.

All the surfaces of the fitting-type box are preferably covered with a plastic, that is, a synthetic resin, including the front and the back of the bottom of the inner box (body), the front and the back of the top of the lid, and the insides and the outsides of the four bent parts of the inner box and the lid as well as the cross sections of the paperboard on the ends of the four peripheral side edges of the bottom and the lid, and no parts of the front, back and cross sections of the paperboard used as the material are exposed.

A standard method for producing the fitting-type box 10 comprises stamping out a thick paper such as a paperboard laminated with a liner such as polyethylene for both the body 6 and the lid 7, ruling half-cut lines into parts corresponding to the bending positions, forming a box shape, and applying a PET pressure-sensitive tape, a resin-impregnated cloth tape, etc. to the paper cross sections.

The paperboard laminated with a plastic film can be formed using the above-mentioned paperboard, and the surface thereof is preferably laminated with polyethylene, etc. at a thickness of 10 to 200 μm, and more preferably 20 to 100 μm.

In order to form a box shape it is necessary to rule lines into parts corresponding to the bending positions, but if the ruled lines are put in too deeply the strength of the box deteriorates, thus causing separation and giving a defect. If the ruled lines are too shallow, bending becomes difficult and the box shape varies, thus resulting in defects. The depth that the ruled lines are put into the paperboard is usually at least ½ of the paperboard thickness, and preferably ½ to 9/10. In the present reusable box, it is preferable to leave at least the thickness of the polyethylene layer on the surface layer in order to prevent the generation of paper dust.

With regard to the subsequent step for bending the paperboard into a box shape and fixing it, a flexible pressure-sensitive tape such as, for example, a PET pressure-sensitive tape manufactured by Nitto Denko Corp. (PET No. 31D, 50 μm×25 mm width) is applied to the insides and outsides of parts which correspond to the corners of the box and in which a cross section of the paper can be seen, thereby preventing exposure of the paper cross section as well as blocking the interior of the box from contact with outside air.

Depending on the weight of the sheet contents, the strength of the box might not be sufficient, and when, for example, there is a possibility that the box might deform when carried by hand, a paperboard of the same material may be stuck along the short and long sides of the box. It is preferable to laminate these reinforcing paperboards to the four peripheral sides so that the box can be used repeatedly as a reusable box.

A tally of the number of times it is used can be written by hand on the box or written by a laser beam at a predetermined position on the box so that it can be read visually or by a machine.

As the final step it is preferable to cover parts on the ends of the four peripheral side edges of the bottom and the lid where the cross section of the paperboard is exposed and to cover the periphery with a flexible tape so as to reinforce all the corners of the box as well. For example, a No. 111 cloth tape having a width of 50 mm and a resin-impregnated surface, manufactured by Okamoto Industries, Inc., can be used.

Both the body 6 and the lid 7 of the fitting-type box can be made by the above-mentioned production method.

The dimensions of the lid are preferably set so that the body and the lid fit together smoothly. The dimensions of the paperboard stamped out for the short and long sides of the lid are both preferably set larger than those of the body by about 5 to 12 mm. Furthermore, the depth of the lid is preferably set larger than that of the body by about 1 to 3 mm.

With regard to the paperboard for forming the body and the lid in the present invention, it is preferable to use a paperboard covered with a plastic, and to cover the parts of the periphery of the body and lid where the cross section of the paperboard is exposed with a pressure-sensitive tape comprising a plastic film or a resin-impregnated cloth tape, which at the same time retains and reinforces the shape of the box.

With regard to the paperboard used for the production of the fitting-type box of the present invention, a liner laminated with a plastic film, a paper impregnated with a latex or a resin, etc. can be used.

With regard to the above-mentioned plastic film, a thermoplastic resin film manufactured from a thermoplastic resin can be used. With regard to a method for providing the thermoplastic film on the paperboard, the lamination method described above can preferably be used. The thermoplastic film is explained more specifically below.

With regard to the thermoplastic resin used in the thermoplastic resin film, there are high density homopolyethylene resins, medium density homopolyethylene resins, low density homopolyethylene resins, various densities of ethylene-α-olefin copolymer resins, vinyl chloride-vinyl acetate copolymer resins, vinyl chloride resins, polyvinylidene chloride resins, EVA resins, EEA resins, EAA resins, EMA resins, acrylic resins, acrylonitrile resins, polyamide resins, polyester resins, polycarbonate resins, polyacetal resins, ethylene-vinyl alcohol (hereinafter called EVOH) copolymer resins, homopolystyrene resins, synthetic rubber modified polystyrene resins, acrylonitrile-butadiene-styrene (ABS) copolymer resins, high impact polystyrene resins, homopolypropylene resins, propylene-α-olefin copolymer resins, cross linked thermoplastic resins, acid modified thermoplastic resins (acid modified polyolefin resins, etc.), thermoplastic elastomers (polystyrenes, polyolefins, polyesters, polyamides, polyurethanes, chlorinated polyethylenes, 1,2-polybutadienes, etc.), etc.

With regard to the thermoplastic resin used in the thermoplastic resin film, crystalline resins are preferred since they are low cost and have excellent heat resistance, photographic properties, heat sealability, Young's modulus, grease resistance, etc. With regard to these crystalline resins, there are various densities of homopolyethylene resins, homopolypropylene resins, propylene-α-olefin copolymer resins, ethylene copolymer resins, polyacetal resins, polyamide resins, polyester resins such as polyethylene terephthalate resin and polyethylene naphthalate resin, polytetrafluoroethylene resins, polyvinylalcohol resins, ethylene-vinyl alcohol copolymer resins, and resins containing 50 wt % or more of one type or two or more types of isotactic polystyrene resin. Polyethylene resins and polypropylene resins are preferred, and low density homopolyethylene resin (hereinafter called LDPE resin), medium density homopolyethylene resin (hereinafter called MDPE resin), high density homopolyethylene resin (hereinafter called HDPE resin), various densities of L-LDPE resin, homopolypropylene resin, and propylene-ethylene copolymer resin are particularly preferred. Among these resins, those formed using a steroregular catalyst are preferred since they have little catalyst residue and residual monomer, which adversely influence the photographic properties of light-sensitive materials. In the case of the thermoplastic resin film, with the object of improving the ability to uniformly disperse light shielding materials such as carbon black and aluminum powder, and reinforcing agents such as glass fiber and potassium titanate, improving the heat seal suitability (in particular maintaining the heat seal strength over time), enhancing the physical strength, etc., it is preferable for an ethylene copolymer resin to be included at 1 to 99.8 wt %. The ethylene copolymer resin is preferably included at 2 to 97 wt %, particularly preferably 5 to 95 wt %, and most preferably 7 to 93 wt %.

Representative examples of the ethylene copolymer resin are shown below.

(1) Ethylene-vinyl acetate copolymer resin
(2) Ethylene-propylene copolymer resin
(3) Ethylene-1-butene copolymer resin
(4) Ethylene-butadiene copolymer resin
(5) Ethylene-vinyl chloride copolymer resin
(6) Ethylene-methyl methacrylate copolymer resin
(7) Ethylene-methyl acrylate copolymer resin
(8) Ethylene-ethyl acrylate copolymer resin
(9) Ethylene-acrylonitrile copolymer resin
(10) Ethylene-acrylic acid copolymer resin
(11) Ionomer resin (a resin formed by crosslinking a copolymer of ethylene and an unsaturated acid using a metal such as zinc)
(12) Ethylene-α-olefin copolymer resin (hereinafter called L-LDPE resin)
(13) Ethylene-propylene-butene-1 ternary copolymer resin
(14) Ethylene-propylene copolymer resin elastomer
(15) Ethylene-propylene-diene ternary copolymer resin elastomer The above-mentioned L-LDPE (Linear Low Density Polyethylene) resin that is particularly preferred in the present invention is called the 'third polyethylene resin' and is a low cost high strength resin that combines the advantages of both medium/low density and high density homopolyethylene resins and conforms to the demands of an energy conservation and resource conservation era. This resin is a polyethylene resin having a linear straight chain structure with short branches, and is a copolymer that is formed by copolymerizing ethylene and an α-olefin having 3 to 20 carbons, preferably 4 to 15 carbons, particularly preferably 5 to 10 carbons, and most preferably 6 to 8 carbons by a low pressure method or a high pressure improved method. There are various types of this α-olefin that can be used, such as linear or branched aliphatic ones, alicyclic ones, and aromatic ones such as styrene. From the point of view of physical strength and cost, aliphatic α-olefins such as propene-1, butene-1, octene-1, hexene-1, 4-methylpentene-1, heptene-1, decene-1, undecene-1, and dodecene-1 are preferably used. These α-olefins that are copolymerized with ethylene can be used singly, or in a combination of two or more types. The density (ASTM D-1505) is generally of the order of that of a low/medium density polyethylene resin, but in the present invention a density in the range of 0.86 to 0.98 g/cm$^3$, and particularly 0.88 to 0.96 g/cm$^3$ is preferred. A melt flow rate (ASTM D-1238, Conditions E) in the range of 0.1 to 80 g/10 min, and particularly 0.3 to 60 g/10 min is preferred. As a polymerization process for the L-LDPE resin there are a gas phase method, a solution method, and a liquid phase slurry method that use a medium/low pressure system, and an ionic polymerization method, etc. that use a high pressure improved method system.

Specific examples of commercial L-LDPE resins are shown below.

Ethylene-butene-1 copolymer resins
- Dowlex (Dow Chemical)
- Sclair (DuPont de Nemour, Canada)
- Marlex (Phillips)
- Stamylex (DSM)
- Excellen VL (Sumitomo Chemical Co., Ltd.)
- Neo-Zex (Mitsui Chemicals, Inc.)
- Mitsubishi Polyethy-LL (Mitsubishi Chemical Corp.)
- Nisseki Linirex (Nippon Petrochemicals Co., Ltd.)
- NUC Polyethylene-LL (Nippon Unicar Co., Ltd.)
- Idemitsu Polyethylene L (Idemitsu Petrochemical Co., Ltd.)

Ethylene-hexene-1 copolymer resins
- Tuflin (UCC)
- Tufthene (Nippon Unicar Co., Ltd.)

Ethylene-4-methylpentene-1 copolymer resins
- Ultzex (Mitsui Chemicals, Inc.)

Ethylene-octene-1 copolymer resins
- Stamylex (DSM)
- Dowlex (Dow Chemical)
- Sclair (DuPont de Nemour, Canada)
- Moretec (Idemitsu Petrochemical Co., Ltd.)

Preferable among these L-LDPE resins, particularly from the point of view of physical strength and film forming characteristics, are those which have a melt flow rate (measured using ASTM D-1238, Conditions E or JIS K-7210 Conditions 4, test temperature 190° C., test load 21.2 N (2.16 kgf; polypropylene resins being measured using ASTM D-1238, Conditions E or JIS K-7210 Conditions 4; test temperature 230° C., test load 21.2 N (2.16 kgf)) of 0.1 to 10 g/10 min, preferably 0.2 to 7 g/10 min, and particularly preferably 0.3 to 5 g/10 min; a density (measured by JIS K-6760 or ASTM D-1505) of 0.860 to 0.950 g/cm$^3$, preferably 0.870 to 0.940 g/cm$^3$, and particularly preferably 0.880 to 0.930 g/cm$^3$; and which are obtained from an α-olefin having 3 to 12 carbons, preferably 4 to 10 carbons, and particularly preferably 6 to 8 carbons by the liquid phase slurry method process and the gas phase method process.

As one preferred mode for carrying out the present invention, there can be cited a fitting-type box comprising a paperboard covered with a thermoplastic resin film to which an antistatic agent has been added.

Antistatic agents are known, and a variety of groups of compounds can be cited, but surfactants are preferably used as the antistatic agent in the present invention.

The addition of an antistatic agent is effective in preventing dirt and dust from becoming attached by static to a plastic material, and in particular to a polyethylene laminate film. With regard to the antistatic agent, there can be cited as an anionic type an alkyl phosphate ester, as a cationic type an alkylamine derivative and a quaternary ammonium salt, as an amphoteric type an imidazoline type metal salt, and as a nonionic type a polyoxyethylene alkylamine, a polyoxyethylene fatty acid ester, and a polyoxyethylene alkyl ether. More specifically, dioxyethylene stearic acid amine, an alkylamine lubricant, stearic acid monoglyceride, etc., can preferably be used.

By adding a surfactant, in addition to preventing static, an improvement in the slip characteristics can be obtained. Furthermore, the addition of a surfactant improves the dispersibility in the thermoplastic resin film of aluminum powder, light-shielding materials, hydrated double salt compounds (representative examples are hydrotalcite type compounds), etc.

The amount of surfactant added is 0.01 to 5.0 wt %, preferably 0.05 to 3.0 wt %, and more preferably 0.1 to 1.5 wt %. If the amount added is less than 0.01 wt %, the effect of adding the surfactant is lost, and there is only an increase in the cost of kneading. Furthermore, if the amount added exceeds 5.0 wt %, slip easily occurs between the molten resin and the screw of the extruder, and the amount of resin discharged is unstable. Moreover, stickiness and bleed out easily occur over time after film formation. Furthermore, the surfactant that has bled out transfers to the photographic light-sensitive layer, thus causing inhibition of development, and thereby degrading the quality.

The surfactants that can be used in the present invention are explained in detail below.

I. Nonionic (1) Alkylamine derivatives: T-B103 (Matsumoto Yushi-Seiyaku Co., Ltd.), T-B104 (Matsumoto Yushi-Seiyaku Co., Ltd.)
- Alkylamide type polyoxyethylene alkylamine: Armostat 310 (Lion Corp.)
- Tertiary amine (laurylamine): Armostat 400 (Lion Corp.)
- N,N-Bis(2-hydroxyethylcocoamide): Armostat 410 (Lion Corp.)
- Tertiary amine: Antistatic 273C, 273, 273E (Fine Org. Chem)
- N-Hydroxyhexadecyl diethanolamine: Belg. P. 654, 049
- N-Hydroxyoctadecyl diethanolamine: (National Dist.)

(2) Fatty acid amide derivatives: TB-115 (Matsumoto Yushi-Seiyaku Co., Ltd.), Elegan P100 (NOF Corp.), Erik SM-2 (Yoshimura Oil Chemical Co., Ltd.) Hydroxystearamide, oxalic acid-N,N'-distearylamide butyl ester: Hoechst Polyoxyethylene alkylamide (3) Ether type Polyoxyethylene alkylether
$RO(CH_2CH_2O)nH$
Polyoxyethylene alkylphenylether
Special non-ionic type: Resistat 104, PE100, 116 to 118 (Dai-ichi Kogyo Seiyaku Co., Ltd.), Resistat PE132, 139 (Dai-ichi Kogyo Seiyaku Co., Ltd.), Elegan E115, Chemistat 1005 (NOF Corp.), Erik BM-1 (Yoshimura Oil Chemical Co., Ltd.), Electrostripper TS, TS2, 3, 5, EA, EA2, 3 (Kao Corp.).

(4) Polyhydric alcohol ester type
Glycerin fatty acid esters: mono-, di-, or triglycerides of stearic acid or hydroxystearic acid, Monogly (Nippon Fine Chemical Co., Ltd.), TB-123 (Matsumoto Yushi-Seiyaku Co., Ltd.), Resistat 113 (Dai-ichi Kogyo Seiyaku Co., Ltd.)
Sorbitan fatty acid esters
Special esters: Erik BS-1 (Yoshimura Oil Chemical Co., Ltd.)
1-Hydroxyethyl-2-dodecylglyoxazoline: British Cellophane II. Anionic
(1) Sulfonic acids; alkyl sulfonates, $RSO_2Na$; alkylbenzene sulfonates; alkyl sulfates, $ROSO_3Na$
(2) Phosphoric acid ester type: alkyl phosphates III. Cationic
(1) Amide type cationic: Resistat PE300, 401, 402, 406, 411 (Dai-ichi Kogyo Seiyaku Co., Ltd.)
(2) Quaternary ammonium salts, quaternary ammonium chlorides, quaternary ammonium sulfates, quaternary ammonium nitrates: Catimine CSM-9 (Yoshimura Oil Chemical Co., Ltd.), Catanac 609 (American Cyanamid), Denon 314C (Marubishi Yuka), Armostat 300 (Lion Corp.), 100V (Armor), Electrostripper-ES (Kao Corp.), Chemistat 2009A (NOF Corp.), Stearamido propyl-dimethyl-β-hydroxyethyl ammonium nitrate: Catanac SN (American Cyanamid).

IV. Amphoteric ionic
(1) Alkyl betaine type:
(2) Imidazoline type: Rheostat 53, 532 (Lion Corp.), AMS 53 (Lion Corp.), AMS 303, 313 (Lion Corp.) Alkylimidazoline type
(3) Metal salt type: AMS 576 (Lion Corp.)
Rheostat 826, 923 (Lion Corp.)
$(RNR'CH_2CH_2CH_2NCH_2COO)_2Mg$ {R≧C, R'═H or $(CH_2)mCOO$—} (Lion Corp.)
(4) Alkyl alanine type V. Others; Resistat 204, 205 (Dai-ichi Kogyo Seiyaku Co., Ltd.), Elegan 2E, 100E (NOF Corp.), Chemistat 1002, 1003, 2010 (NOF Corp.), Erik 51 (Yoshimura Oil Chemical Co., Ltd.), Alromine RV-100 (Geigy), and, furthermore, various surfactants disclosed in the 'Plastic Data Handbook' (KK Kogyo Chosakai Publishing Co., Ltd., published Apr. 5, 1984) pages 776 to 778, etc., and the type and amount added can be selected therefrom.

Among the above-mentioned surfactants, nonionic surfactants are particularly preferred since there is little adverse influence on photographic properties or the human body, and they have a large effect in preventing static marks.

As other preferred modes for carrying out the present invention, there are fitting-type boxes using a thermoplastic resin film containing one or more type of additive, selected from lubricants, anti-blocking agents, antioxidants, UV absorbers, anti-aging agents, etc. in combination with a surfactant.

These additives are known and are described, for example, in JP-A-8-254793. That is, lubricants and anti-blocking agents are described in paragraphs 0069 to 0090 of the same publication, and antioxidants, etc. are described in paragraphs 0091 to 0168 of the same publication.

The stack of light-sensitive material that is packaged in the light-sensitive material package of the present invention is formed from a plurality of stacked sheets of photosensitive sheet-form light-sensitive material; for example there are stacked products such as X-ray photographic film, light-sensitive printing material, printing paper, light-sensitive material for lithographic printing (generally known as light-sensitive material for PS plate), heat-developable light-sensitive materials, and glass dry-plates. The light-sensitive material package of the present invention is suitable for stacks of light-sensitive material sheets weighing 3 kg or above, and preferably 3 to 5 kg.

The heat-developable light-sensitive materials are preferably of the mono-sheet type (a type in which an image can be formed on a heat-developable light-sensitive material rather than using a separate sheet such as an image receiving material).

The heat-developable light-sensitive material has a light-sensitive layer containing a light-sensitive silver halide (catalytically active amount of a photocatalyst) and a reducing agent, and a non light-sensitive layer. The light-sensitive layer preferably further contains a binder (generally a synthetic polymer), an organic silver salt (reducible silver source) and a reducing agent. Furthermore, a hydrazine compound (ultra high contrast enhancing agent) and a color tone adjustment agent (to control the color tone of the silver) are preferably included. A plurality of light-sensitive layers can be included. For example, with the object of controlling the gradation, a high speed light-sensitive layer and a low speed light-sensitive layer can be provided in the heat-developable light-sensitive material. With regard to the order in which the high speed light-sensitive layer and the low speed light-sensitive layer are arranged, the low speed light-sensitive layer can be disposed underneath (support side) or the high speed light-sensitive layer can be disposed underneath.

The non light-sensitive layer can be provided as a dye-containing layer, that is, a filter layer and an antihalation layer, as well as a different functional layer such as a surface protection layer.

With regard to the support for the light-sensitive material, paper, polyethylene laminated paper, polypropylene laminated paper, parchment, cloth, a sheet or thin film of a metal (e.g., aluminum, copper, magnesium, zinc), glass, and glass or plastic film laminated with a metal (e.g., chrome alloy, steel, silver, gold, platinum) can be used. Transparent plastic films are preferable, and examples of plastics that can be used as the support include polyalkyl methacrylates (e.g., polymethyl methacrylate), polyesters (e.g., polyethylene terephthalate: PET), polyvinyl acetal, polyamides (e.g., nylon), and cellulose esters (e.g., cellulose nitrate, cellulose acetate, cellulose acetate propionate, cellulose acetate butyrate). In particular, those with a thickness of 170 to 200 μm are preferable as the support. In the present invention, polyethylene terephthalate is preferably used.

In the present invention a matting agent may be included in the surface protection layer, and preferably in the outermost surface layer. By adding the matting agent, adhesion when stacking the light-sensitive material sheets can be prevented. Fine grains of generally water-insoluble organic or inorganic compounds can preferably be used as the matting agent. For example, as specific examples of organic compounds that can be used as the matting agent, water-dispersible vinyl polymers such as polymethyl acrylate, polymethyl methacrylate, polyacrylonitrile, acrylonitrile-α-methyl styrene copolymer, polystyrene, styrene-divinylbenzene copolymer, polyvinyl acetate, polyethylene carbonate, and polytetrafluoroethylene; cellulose derivatives such as methyl cellulose, cellulose acetate, and cellulose acetate propionate; starch derivatives such as carboxy starch, carboxynitrophenyl starch, and urea-formaldehyde-starch reaction products; gelatin hardened with a known hardening agent; and hardened gelatin in the form of microcapsule hollow particles obtained by coacervate hardening are preferably used. As examples of the inorganic compounds that can be preferably used, there are silicon dioxide, titanium dioxide, magnesium dioxide, aluminum oxide, barium sulfate, calcium carbonate, silver chloride desensitized by a known method, silver bromide similarly processed, glass, and diatomaceous earth. A variety of different types of the above-mentioned matting agents can be mixed and used as necessary.

As a preferred light-sensitive material in the light-sensitive material package of the present invention, there is black and white film used for forming images with line widths of 200 to 500 μm in general, 100 to 200 μm for precision machinery, and 1 to 100 μm for ultra-high-precision machinery. Specifically, there can be cited, for example, IP-S175A, N IP-R175A, and N IP-L175A (size: 202 mm×303 mm to 660 mm×940 mm) made by Fuji Photo Film Co., Ltd. These are suitable as mask films for the manufacture of boards for industrial use (PCB; printed circuit boards)

Furthermore, the packaging material for light-sensitive material of the present invention can be applied not only to light-sensitive materials such as film and glass dry plates, but can also be used for the general packaging of heat sensitive film, PS plate sheets, etc.

EXAMPLES

Specific examples of the present invention are explained below, but the present invention is not limited thereby.

Example 1

As shown in FIG. 1, a stack of sheet-form light-sensitive material (manufactured by Fuji Photo Film Co., Ltd., product name: IP-S175A, support thickness: 175 μm, size: 50.8×61 cm, number of sheets: 50 sheets, weight: 3 kg) was packaged with a protecting sheet made of a polypropylene sheet and stored in an envelope having a stiffness at heat-seal parts of 0.15 N·cm, and four edges were heat-sealed. The envelope was stored in a fitting-type box in a state in which a cushioning member (FIG. 5A) extending the whole length of the heat-seal part on the four edges of the envelope was enclosed below.

Examples 2 to 4

The procedure of Example 1 was repeated except that the cushioning member abutted against only a part of the heat-seal parts as shown in FIGS. 5B, 5C, and 5D to give samples of Examples 2 to 4.

Comparative Example 1

As Comparative Example 1, an envelope was stored in a fitting-type box without using a cushioning member in a state in which the heat-seal part extended outward.

Comparative Example 2

As Comparative Example 2, an envelope was stored in a fitting-type box with an enclosed cushioning member shown in FIG. 5A in a state in which the heat-seal parts were folded toward the inside of the envelope and not held down by the cushioning member.

After carrying out a vibration test as specified in JIS Z0200, bag tear and scratches were evaluated. The results are summarized in Table 1.

TABLE 1

| Sample | Conformation held down in | Bag tear | Scratches (number) |
|---|---|---|---|
| Comp. Ex. 1 | None | XX | 156 to 180 |
| Example 1 | A | O | 10 to 15 |
| Example 2 | B | O | 35 to 40 |
| Example 3 | C | O | 33 to 40 |
| Example 4 | D | O | 20 to 33 |
| Comp. Ex. 2 | A (Not held down) | X | 156 to 165 |

Bag tear:
XX A hole (diameter 1 mm or above) that allowed light to enter the envelope and allowed the light-sensitive material to be exposed to light.
X A hole that allowed air to enter but did not allow light to enter the envelope.
O No hole.
Scratches: Number of scratches having a length of 10 μm or above per sheet of film.

Examples 5 to 7, Comparative Example 3

A light-sensitive material (manufactured by Fuji Photo Film Co., Ltd., product name: IP-S175A, support thickness: 175 μm, size: 50.8×61 cm, number of sheets: 50 sheets, weight: 3 kg) was stored in a protecting sheet made of a polypropylene sheet, stored in an envelope having a stiffness at heat-seal parts of 0.1 N·cm, and the envelope was stored in a fitting-type box with a cushioning member placed on the heat-seal parts (enclosed above) while changing the amount held down (width over which the cushioning member holds down the heat-seal parts) to 2, 5, and 10 mm. After carrying out a vibration test as specified in JIS Z0200, bag tear and scratches were evaluated.

TABLE 2

| Sample | Amount held down (mm) | Bag tear | Scratches (number) |
|---|---|---|---|
| Comp. Ex. 3 | 0 | X | 156 to 165 |
| Example 5 | 2 | O | 20 to 35 |
| Example 6 | 5 | O | 10 to 15 |
| Example 7 | 10 | O | 10 to 15 |

Bag tear:
XX A hole (diameter 1 mm or above) that allowed light to enter the envelope and allowed the light-sensitive material to be exposed to light.
X A hole that allowed air to enter but did not allow light to enter the envelope.
O No hole.
Scratches: Number of scratches having a length of 10 μm or above per sheet of film.

The effects of the present invention are clear from Table 1 and Table 2.

In accordance with use of the light-sensitive material package of the present invention, the problems of bag tear and scratches can be eliminated at low cost without changing the size of the fitting-type box. Furthermore, it is possible to decrease the strength of the bag material, thereby reducing the cost of the bag and enhancing the quality of the bag.

The present invention is particularly effective when the weight of the stack of light-sensitive material is 3 kg or above. The present invention is also effective when the thickness of the support of the light-sensitive material is 170 μm to 200 μm.

Example 8

NRK liner (manufactured by Oji Paper Co., Ltd., basis weight 280 g/m$^2$) and Ultrazex 2021L (manufactured by Mitsui Chemicals Inc., LDPE, thickness 40 $\mu$m) were bonded together by extrusion lamination using Petrothene (manufactured by Tosoh Corporation, LDPE), and the laminate was then further bonded to a paperboard (basis weight 1950 g/m$^2$) using an emulsion type adhesive.

Next, a fitting-type box as shown in FIG. 4 was formed using the packaging material for light-sensitive material obtained as above.

A stack of sheet-form light-sensitive material (manufactured by Fuji Photo Film Co., Ltd., product name: N IP-R175A, support thickness: 175 $\mu$m, size: 50.8×61 cm, number of sheets: 100 sheets) was packaged with a protecting sheet made of a polypropylene sheet and stored in an envelope, and four edges were heat-sealed. As shown in FIG. 4, the envelope was stored in a fitting-type box, in a state in which a cushioning member extending the whole length of the heat-seal parts on the four edges of the envelope was enclosed below the heat-seal parts, to give a light-sensitive material package.

A vibration test was carried out according to JIS Z0200 using the light-sensitive material package of Example 8. Subsequently, the envelope was taken out of the fitting-type box and brought into a Class 1,000 clean room as it was, without removing dirt, etc. adhering to the envelope.

Evaluation was made by visual inspection of the inside of the fitting-type box and by dust count within the clean room. The results are given in Table 3.

TABLE 3

| | Visual inspection | Dust counter |
|---|---|---|
| Example 8 | Scratched, no paper dust generated | 1,000 particles/cf or below |

In accordance with the light-sensitive material package employing the packaging material for light-sensitive material, it is possible to prevent dirt from becoming attached to the light-sensitive material at low cost. Furthermore, since the fitting-type box formed from the light-sensitive material packaging material comprising a thermoplastic resin layer can be easily cleaned of dirt that becomes attached to the surface during use, the fitting-type box can be reused. This is an effective improvement in terms of the environment and cost.

Example 9

A fitting-type box storing black and white film having a sheet size of 515×665 mm was produced by laminating, on a paperboard, a polyethylene film to which an antistatic agent had been added, as follows.

Two sheets of chipboard having a basis weight of 700 g/m$^2$ were bonded together as an inner layer, and the front and back sides thereof were further bonded to polyethylene laminate liners formed by laminating a 30 $\mu$m thick polyethylene film on one side of a 280 g/m$^2$ liner, so that the polyethylene was exposed on the surface, thus giving a paperboard for box making.

The polyethylene was a low density polyethylene (LDPE) to which Elestmaster LL-10 (nonionic surfactant) manufactured by Kao Corp. had been added as an antistatic agent at 0.2 wt % of the polyethylene. As for the method of addition, a master batch containing the antistatic agent at 10 wt % was used, and the master batch was added to the LDPE at 2 wt %.

The fitting-type box for storing the above-mentioned sheet size was set so as to have internal dimensions of 562×715 mm and a height of 25 mm, and external dimensions of 564×717 mm and a height of 25 mm. In order to make this box, the unfolded dimensions (external stamping dimensions) of the paperboard were 614×767 mm.

Next, as for the step for bending the paperboard into a box shape and fixing it, a flexible pressure-sensitive tape such as, for example, a PET pressure-sensitive tape manufactured by Nitto Denko Corp. (PET No. 31D, 50 $\mu$m×25 mm width) was applied to the insides and outsides of open parts which corresponded to the corners of the box and in which cross sections of the paper could be seen, thereby preventing exposure of the paper cross section as well as blocking the interior of the box from contact with outside air. Next, in order to enhance the strength of the box, paperboard of the same material was laminated to the four peripheral sides along the short and long sides of the box. As the final step, parts where the cross section of the paperboard was exposed were covered and all the corner parts of the box were reinforced using a cloth tape No. 111 having a width of 50 mm and a resin-impregnated surface, manufactured by Okamoto Industries, Inc.

The lid of the fitting-type box was made in the same manner as for the body.

The dimensions of the lid were set about 9 mm larger for both the short and long sides of the box in the paperboard stamping dimensions so that the body and the lid fitted smoothly together. The depth was set about 2 mm larger.

As shown in FIG. 2, a stack of sheet-form light-sensitive material (manufactured by Fuji Photo Film Co., Ltd., product name: IP-S175A, support thickness: 175 $\mu$m, size: 50.8×61 cm, number of sheets: 50 sheets, weight: 3 kg) was packaged with a protecting sheet made of a polypropylene sheet and stored in an envelope having a stiffness at heat-seal parts of 0.15 N·cm, and four edges were heat-sealed. As shown in FIG. 4, the envelope was stored in a fitting-type box in a state in which a cushioning member extending the whole length of the heat-seal parts in the four edges was enclosed below the heat-seal parts.

A vibration test (according to JIS Z0200) was carried out for the sample below, and the amount of paper dust generated was measured.

(1) A fitting-type box whose whole surface was laminated with polyethylene and to which a resin-impregnated cloth tape had been applied in accordance with the present invention Amounts of paper dust generated (number of particles of paper dust attached to the surface of the envelope) were as follows.

| | |
|---|---|
| (Sample 1) with one vibration test | 0 |
| (Sample 1) with five vibration tests | 0 |

A dust-free fitting-type box that prevents the generation of paper dust, etc. can be obtained and, moreover, the box can be used as a reusable fitting-type box that can be used a plurality of times.

What is claimed is:

1. A light-sensitive material package comprising:

a fitting-type box comprising an inner box and a lid;

a light-shielding envelope containing a stack of sheet-form light-sensitive material, the light-shielding envelope having heat-seal parts on four edges and being stored in the fitting-type box; and a cushioning member for holding down all or a part of the heat-seal parts;

wherein the stiffness of the heat-seal parts is at least 0.05 N·cm.

2. The light-sensitive material package according to claim 1 wherein the weight of the stack of light-sensitive material is 3 kg or above.

3. The light-sensitive material package according to claim 1 wherein the light-sensitive material has a support with a thickness of 170 $\mu$m to 200 $\mu$m.

4. The light-sensitive material package according to claim 1 wherein the stack of light-sensitive material is packaged with a protecting sheet formed from a polypropylene sheet, and stored in the envelope, the stack of light-sensitive material being in direct contact with the protecting sheet.

5. The light-sensitive material package according to claim 1 wherein the stiffness of an inner packaging material used for the envelope is at least 0.01 N·cm.

6. The light-sensitive material package according to claim 1 wherein the tear strength of an inner packaging material used for the envelope is at least 1.5 N·cm.

7. The light-sensitive material package according to claim 1 wherein the pressure within the envelope is 10 to 500 mm·$H_2O$.

8. The light-sensitive material package according to claim 1 wherein the cushioning member is disposed below the heat seal parts of the envelope stored in the inner box.

9. The light-sensitive material package according to claim 1 wherein the width over which the cushioning member holds down all or a part of the heat-seal parts is 2 to 10 mm.

10. The light-sensitive material package according to claim 1 wherein, when the cushioning member is enclosed below the heat-seal parts, in the case where the depth of the fitting-type box is 20 mm the height that the heat-seal parts are to be pushed down between the cushioning member and the lid of the fitting-type box is 1 to 5 mm before the lid is applied.

11. The light-sensitive material package according to claim 1 wherein the body and the lid of the fitting-type box are fixed by pressure-sensitive tape.

12. The light-sensitive material package according to claim 1 wherein the cushioning member is a foam formed by adding a foaming agent to a polyethylene resin, a polypropylene resin, a polyolefin resin, an ethylene copolymer resin, a copolymer resin having propylene as a main component, a polyolefin cross-linked resin, a polyamide resin, a mixed resin of one or two or more of said resins, a polyurethane, a natural rubber, or a synthetic rubber.

13. The light-sensitive material package according to claim 1 wherein the fitting-type box is formed from a paperboard, a thermoplastic resin layer being laminated on the front and back sides of the paperboard.

14. The light-sensitive material package according to claim 13 wherein the thermoplastic resin layer is a layer comprising a polyolefin.

15. The light-sensitive material package according to claim 13 wherein the thickness of the thermoplastic resin layer is 10 $\mu$m to 200 $\mu$m.

16. The light-sensitive material package according to claim 13 wherein the sheet-form light-sensitive material is light-sensitive material for forming an image having a line width of 500 $\mu$m or below.

17. The light-sensitive material package according to claim 1 wherein all the front, back, and cross section of the paperboard forming the inner box and the lid of the fitting-type box are covered with a plastic.

18. The light-sensitive material package according to claim 17 wherein the paperboard is covered with a thermoplastic resin film to which an antistatic agent has been added.

19. The light-sensitive material package according to claim 18 wherein the antistatic agent is a nonionic surfactant.

* * * * *